US010221588B2

(12) United States Patent
Edwards et al.

(10) Patent No.: US 10,221,588 B2
(45) Date of Patent: Mar. 5, 2019

(54) KEY FOR OPERATING A LOCK MECHANISM AND KIT OF PARTS

(71) Applicant: Jaguar Land Rover Limited, Coventry, Warwickshire (GB)

(72) Inventors: Sean Edwards, Coventry (GB); Howard Siswick, Coventry (GB); Mohammed Khan, Coventry (GB)

(73) Assignee: Jaguar Land Rover Limited, Coventry, Warwickshire (GB)

( * ) Notice: Subject to any disclaimer, the term of this patent is extended or adjusted under 35 U.S.C. 154(b) by 0 days.

(21) Appl. No.: 15/552,771

(22) PCT Filed: Feb. 26, 2016

(86) PCT No.: PCT/EP2016/054083
§ 371 (c)(1),
(2) Date: Aug. 22, 2017

(87) PCT Pub. No.: WO2016/135290
PCT Pub. Date: Sep. 1, 2016

(65) Prior Publication Data

US 2018/0038131 A1 Feb. 8, 2018

(30) Foreign Application Priority Data

Feb. 27, 2015 (GB) ..... 1503358.2

(51) Int. Cl.
*E05B 19/04* (2006.01)
*E05B 19/00* (2006.01)
(Continued)

(52) U.S. Cl.
CPC ..... *E05B 19/043* (2013.01); *E05B 19/0082* (2013.01); *E05B 19/14* (2013.01); *E05C 21/00* (2013.01)

(58) Field of Classification Search
CPC .... E05B 19/00; E05B 19/0082; E05B 19/043; E05B 19/14; E05B 19/18
See application file for complete search history.

(56) References Cited

U.S. PATENT DOCUMENTS 89,886 A 5/1869 Parker
146,536 A * 1/1874 Lewis ..... E05B 19/043 70/396
(Continued)

FOREIGN PATENT DOCUMENTS

CZ 2156 U 8/1994
DE 34 37 439 A1 4/1986
(Continued)

OTHER PUBLICATIONS

Patents Act 1977: Combined Search and Examination Report under Sections 17 and 18(3), GB Application No. GB1503358.2, dated Mar. 27, 2015, 9 pp.
(Continued)

*Primary Examiner* — Christopher J Boswell
(74) *Attorney, Agent, or Firm* — Myers Bigel, P.A.

(57) ABSTRACT

The present disclosure relates to a key (101) for operating a lock mechanism (L). The key (101) includes a shank (105); and a blade (107) having a lock operating bit portion (111). The blade (107) is movable relative to the shank (105) between an operative position and a non-operative position. The blade (107) is disposed alongside the shank (105) in said non-operative position. The present disclosure also relates to key (101) in combination with a key fob; and a kit comprising a key (101) and a lock mechanism (L).

15 Claims, 5 Drawing Sheets

(51) Int. Cl.
*E05B 19/14* (2006.01)
*E05C 21/00* (2006.01)

(56) References Cited

U.S. PATENT DOCUMENTS 149,191 A 3/1874 Brady
160,660 A * 3/1875 Erbe ..... E05B 19/043 70/396
1,522,500 A * 1/1925 Curtis ..... E05B 19/00 5/168
3,173,280 A * 3/1965 Oberacker ..... A45C 11/324 70/456 R
3,533,254 A * 10/1970 Albert ..... E05B 35/004 70/276
4,325,243 A * 4/1982 Toyoda ..... A44B 6/00 70/456 R
4,941,569 A * 7/1990 Lindnnayer ..... A45C 11/324 206/37.1
5,541,571 A * 7/1996 Ochs ..... B60R 25/24 307/10.1
5,666,835 A 9/1997 Keller
5,943,889 A * 8/1999 Chiu ..... A45C 11/324 70/456 R
6,035,679 A * 3/2000 Meroni ..... E05B 19/04 70/396
2006/0150696 A1 7/2006 Eychenne et al.
2007/0214851 A1 9/2007 Yamaguchi et al.
2014/0230329 A1 8/2014 Patel

FOREIGN PATENT DOCUMENTS

DE 10 2014 202 731 A1 8/2014
EP 2 221 241 A1 8/2010
EP 2 987 930 A1 2/2016
JP 2009-102954 A 5/2009
TW M339561 9/2008

OTHER PUBLICATIONS

International Search Report and Written Opinion of the International Searching Authority, International Application No. PCT/EP2016/054083, dated May 30, 2016, 14 pp.
Communication pursuant to Article 94(3) EPC, EP Application No. 16706376.7, dated Sep. 10, 2018, 5 pp.

* cited by examiner

KEY FOR OPERATING A LOCK MECHANISM AND KIT OF PARTS

RELATED APPLICATIONS

This application is a 35 U.S.C. § 371 national stage application of PCT Application No. PCT/EP2016/054083, filed on Feb. 26, 2016, which claims priority from Great Britain Patent Application No. 1503358.2, filed on Feb. 27, 2015, the contents of which are incorporated herein by reference in their entireties. The above-referenced PCT International Application was published in the English language as International Publication No. WO 2016/135290 A1 on Sep. 1, 2016.

TECHNICAL FIELD

The present disclosure relates to a key for operating a lock mechanism. Aspects of the invention relate to a key; to a key in combination with a key fob; and to a kit of parts.

BACKGROUND

It is known to use an electronic key fob to operate a lock mechanism (i.e. to unlock and/or lock the lock mechanism) of an automotive vehicle. The electronic key fob typically comprises a radio frequency (RF) transmitter for communicating wirelessly with a control unit disposed in the vehicle. The electronic key fob performs an authentication process with the control unit to operate the lock mechanism. In the event of the electronic key fob becoming inoperable, for example due to a depleted battery, a mechanical key can be used to operate the lock mechanism. The key is typically disposed in the electronic key fob to ensure that it remains available to the user.

An example of a known mechanical key 1 is illustrated in FIGS. 1A and 1B. The key 1 comprises a blade 3 having a bit portion 5. The blade 3 is made from a single piece of material, such as steel, aluminium or reinforced plastic. The bit portion 5 is machined into the blade 3 and provides a coded pattern which, in use, cooperates with a series of tumblers to unlock a lock mechanism (not shown). A handle 7 is disposed at an end of the blade 3 to facilitate application of a turning force to operate the lock mechanism. The handle 7 is pivotally mounted to the blade 3 and can be moved between a storage position and a deployed position. The mechanical key 1 is adapted to be stored in a compartment within the body of an associated electronic key fob. In an alternative arrangement, the mechanical key can be pivotally mounted to a body of the electronic key fob. In order to maintain security, the bit portion 5 must be sufficiently long to engage a plurality of tumblers within the lock mechanism. Consequently, there is limited scope to reduce the size of the electronic key fob in which the key 1 is stored.

It is against this background that the present invention has been conceived. At least in certain embodiments, the present invention seeks to overcome or ameliorate at least some of the problems and shortcomings associated with known keys.

SUMMARY OF THE INVENTION

Aspects of the present invention relate to a key for operating a lock mechanism; to a key in combination with a key fob; and to a kit of parts comprising a key and a lock mechanism.

According to an aspect of the present invention there is provided a key for operating a lock mechanism. The key may comprise a shank and a blade having a lock operating bit portion. The blade may be movable relative to the shank between an operative position and a non-operative position. The blade may be disposed alongside the shank in said non-operative position. In the non-operative position, the blade may be juxtaposed to the shank in a side-by-side arrangement.

The blade and the shank may be disposed along a longitudinal axis when the blade is disposed in said operative position.

The blade could undergo translation relative to the shank when moving between said operative and non-operative positions. For example, first and second pivoting couplings could couple the blade to the shank to form a four-bar link arrangement.

Alternatively, the blade may pivot relative to the shank when moving between said operative and non-operative positions. The blade may be pivotally coupled to the shank so as to pivot between said operative position and said non-operative position. The blade may be configured to pivot through approximately 180° relative to the shank. As the blade is pivoted relative to the shank, the key may be considered as being folded. It will be appreciated therefore that the key may be disposed in a folded configuration when the blade in said non-operative position; and in an unfolded configuration when the blade is in said operative position.

A pivoting coupling may pivotally mount the blade to the shank. A pivot link may be disposed between the shank and the blade, the pivot link being pivotally connected to the shank and to the blade. The pivot link may form an articulated joint between the shank and the blade of the key. The pivot link may be disposed in first and second recesses formed in respective ends of the shank and the blade. The ends of the shank and the blade may abut each other when the blade is in the operative position. First and second pivot pins may pivotally couple the pivot link to the blade and to the shank respectively. In use, the pivot link may be configured to locate at least partially within the lock mechanism.

The first pivot pin may define a first pivot axis; and the second pivot pin may define a second pivot axis. The first pivot axis and/or the second pivot axis may be substantially perpendicular to a longitudinal axis of the key. In use, the key may be rotated about said longitudinal axis to operate a lock mechanism. The first pivot axis may be substantially parallel to the second pivot axis. A handle may be pivotally mounted to the shank to pivot about a third pivot axis. The third pivot axis may be substantially perpendicular to the first pivot axis, the second pivot axis and the longitudinal axis of the key.

The pivot link may be configured to enable pivoting movement in a first direction from the operative position and to inhibit pivoting movement in a second direction from the operative position. The first direction is opposite to the second direction. This arrangement limits pivoting movement of the blade when it is in its operative position, thereby providing at least some lateral rigidity when the key is inserted into the lock mechanism.

The pivot link may be pivotable through approximately 90° in said first direction relative to the shank. The blade may be pivotable through approximately 90° in said first direction relative to the pivot link.

The key may comprise a handle mounted to the shank, the handle being pivotable between a storage position and a deployed position. When the handle is in said storage position, at least a portion of the handle may be disposed between the blade and the shank. When pivoted to said deployed position, the handle may function as a lever for applying a turning force to the key. When the handle is pivoted to said storage position, at least a portion of the shank may be nested in the handle. The handle may be in the form of a C-shaped member, a U-shaped member or an L-shaped member.

The pivot link may be configured such that the blade and the shank are arranged substantially parallel to each other when said handle is in said storage position.

The pivot link may be pivotally connected to the shank at a first pivot axis and pivotally connected to the blade at a second pivot axis parallel to the first pivot axis. The handle may be pivotally connected to the shank at a third pivot axis perpendicular to the first pivot axis and second pivot axis.

The blade may be substantially the same length as the shank. When the blade is in the non-operative position, the length of the key may be halved.

The shank may be operatively configured to apply torque to the lock mechanism to rotate a barrel in order to operate the lock mechanism. The pivot link may be positioned along the length of the key such that the shank engages the barrel to transmit torque to the lock mechanism. The shank may, for example, engage an outer plate or a face plate of the barrel. Thus, the shank may transmit torque to the lock mechanism to reduce rotational loads applied to the blade and the pivot link, if fitted.

The key may comprise a spring member for biasing the blade towards said operative position or towards said non-operative position.

The key may comprise a locking mechanism for locking the blade in said operative position.

The blade may consist of a unitary rigid member, for example formed from a single piece of steel, aluminium or reinforced plastic. The lock operating bit portion may be formed in the unitary rigid member. At least in certain embodiments, the entire lock operating bit portion may be formed in the unitary rigid member. The lock operating bit portion may be machined in the blade.

The key described herein may be configured to operate a lock mechanism of an automotive vehicle.

According to a further aspect of the present invention there is provided a key as described herein in combination with a key fob. The key fob may comprise a storage compartment for storing the key when the blade is in said non-operative position. The key fob may be an electronic key fob for communicating with a control unit. The electronic key fob may comprise a radio frequency (RF) transmitter.

The key could be supplied in combination with a lock mechanism. According to a further aspect of the present invention, there is provided a kit of parts comprising a key and a lock mechanism; the key comprising: a shank and a blade, the blade being pivotally mounted to the shank by a pivoting coupling; the lock mechanism comprising a barrel for receiving the blade of the key; wherein the pivoting coupling is configured to locate at least partially within the barrel of the lock mechanism such that the shank of the key is operative to rotate the barrel. The pivoting coupling may be positioned along the length of the key such that, when the blade is inserted into the barrel, at least a portion of the shank is operative to engage the barrel to transmit torque. The shank may, for example, engage an outer plate or a face plate of the barrel. At least a portion of the pivoting coupling may be disposed within the barrel when the blade is inserted. The pivoting coupling may comprise a pivot link.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment may be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the present invention will now be described, by way of example only, with reference to the accompanying drawings, in which.

DETAILED DESCRIPTION

Figure 1B:
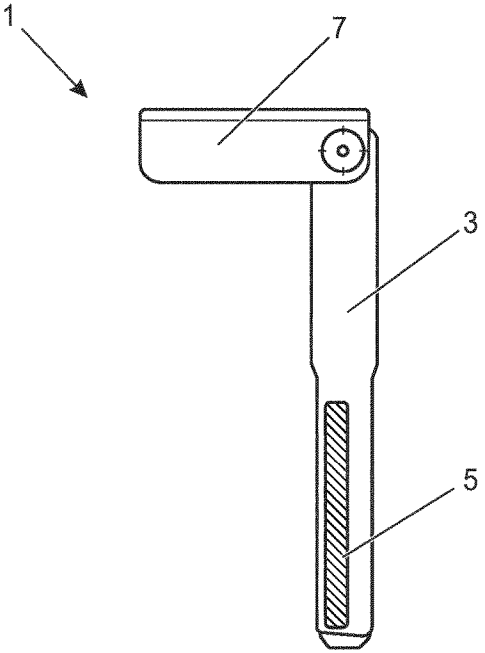
FIGS. 1A and 1B show a prior art key with the operating handle in storage and deployed positions.
Figure 1A:
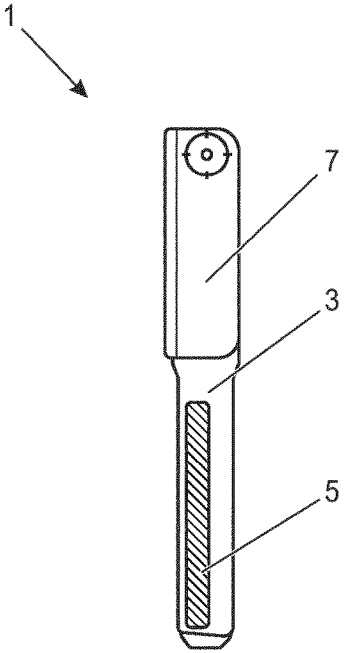
FIG. 1A PRIOR ART

A key 101 in accordance with an embodiment of the present invention will now be described with reference to FIGS. 2 to 6. The key 101 is a mechanical key for operating a lock mechanism L associated with an automotive vehicle (not shown), for example in a door or a tailgate. The key 101 is intended as a backup for an electronic key fob 103 in the event that the electronic key fob 103 becomes inoperable. The key 101 can be referred to as a mechanical emergency key since it is intended primarily for use when the electronic key fob 103 is inoperable. The key 101 according to the present embodiment is intended to be stored in the electronic key fob 103, but the invention is not limited in this respect.

The key 101 comprises a shank 105, a blade 107, and a handle 109. The shank 105 and the blade 107 each have a unitary construction and are formed from first and second lengths of metal. A lock operating bit portion 111 is machined into the blade 107 to provide a coded pattern which, in use, cooperates with a series of tumblers (or pins) in the lock mechanism L. The lock operating bit portion 111 (shown in FIGS. 2A, 3 and 5B) can be formed along an edge of the blade 107 or in one or both side faces of the blade 107 depending on the configuration of the lock mechanism L.

Figure 2A:
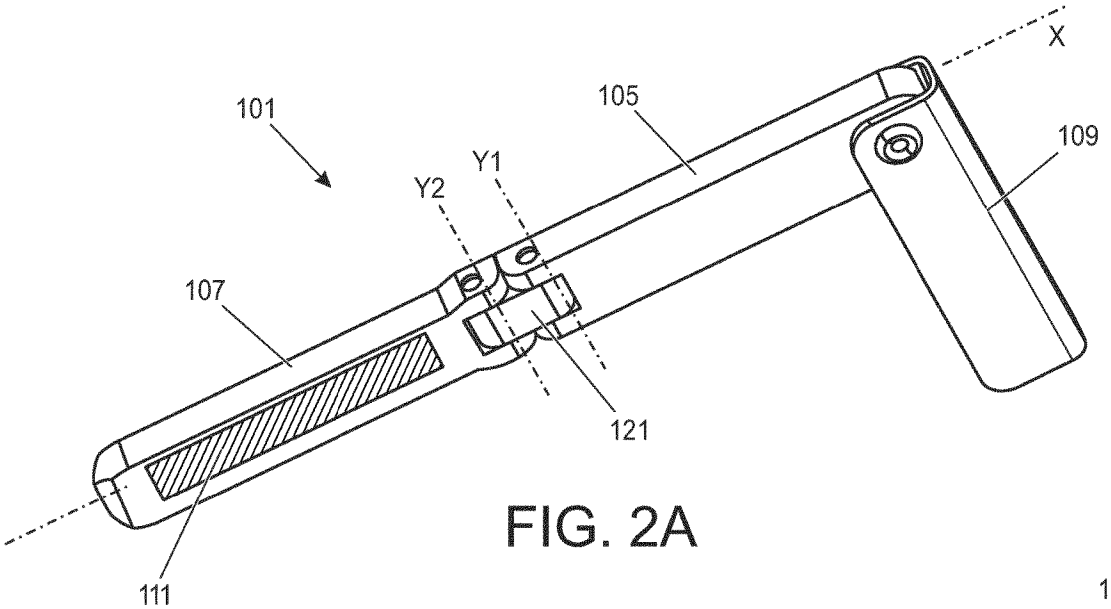
FIGS. 2A and 2B show perspective views of a key in accordance with an embodiment of the present invention in which the blade is shown in operative and non-operative positions respectively.
Figure 2B:
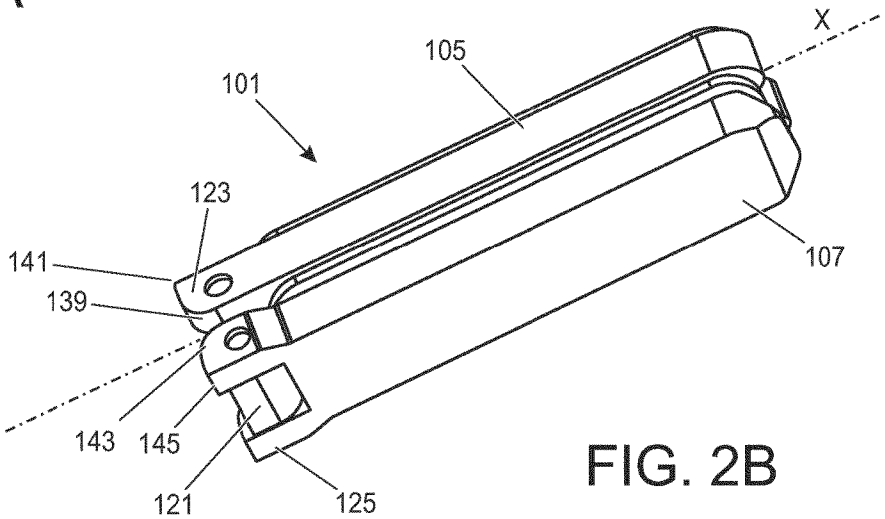

The blade 107 is pivotally coupled to the shank 105 to enable the blade 107 to pivot between an operative position, as shown in FIG. 2A; and a non-operative position, as shown in FIG. 2B. The pivoting arrangement of the blade 107 allows the key 101 to be folded. The key 101 is in a folded configuration when the blade 107 is in said non-operative position; and in an unfolded configuration when the blade 107 is in said operative position. In the non-operative position, the blade 107 is disposed alongside the shank 105 in a face-to-face arrangement. The key 101 cannot be used to operate the lock mechanism L when the blade 107 is in said non-operative position. In the operative position, the blade 107 is aligned with the shank 105 and both the shank 105 and the blade 107 extend along a longitudinal axis X. The key 101 can operate the lock mechanism L by rotating it about the longitudinal axis X when the blade 107 is in said operative position. The shank 105 and the blade 107 are the same length as each other (approximately 30.85 mm in the present embodiment) and the same thickness (approximately 2.9 mm in the present embodiment). When the blade 107 is moved to its operative position, the length of the key 101 is determined by the length of the shank 105 and the blade 107 (approximately 62.95 mm in the present embodiment).

Figure 3:
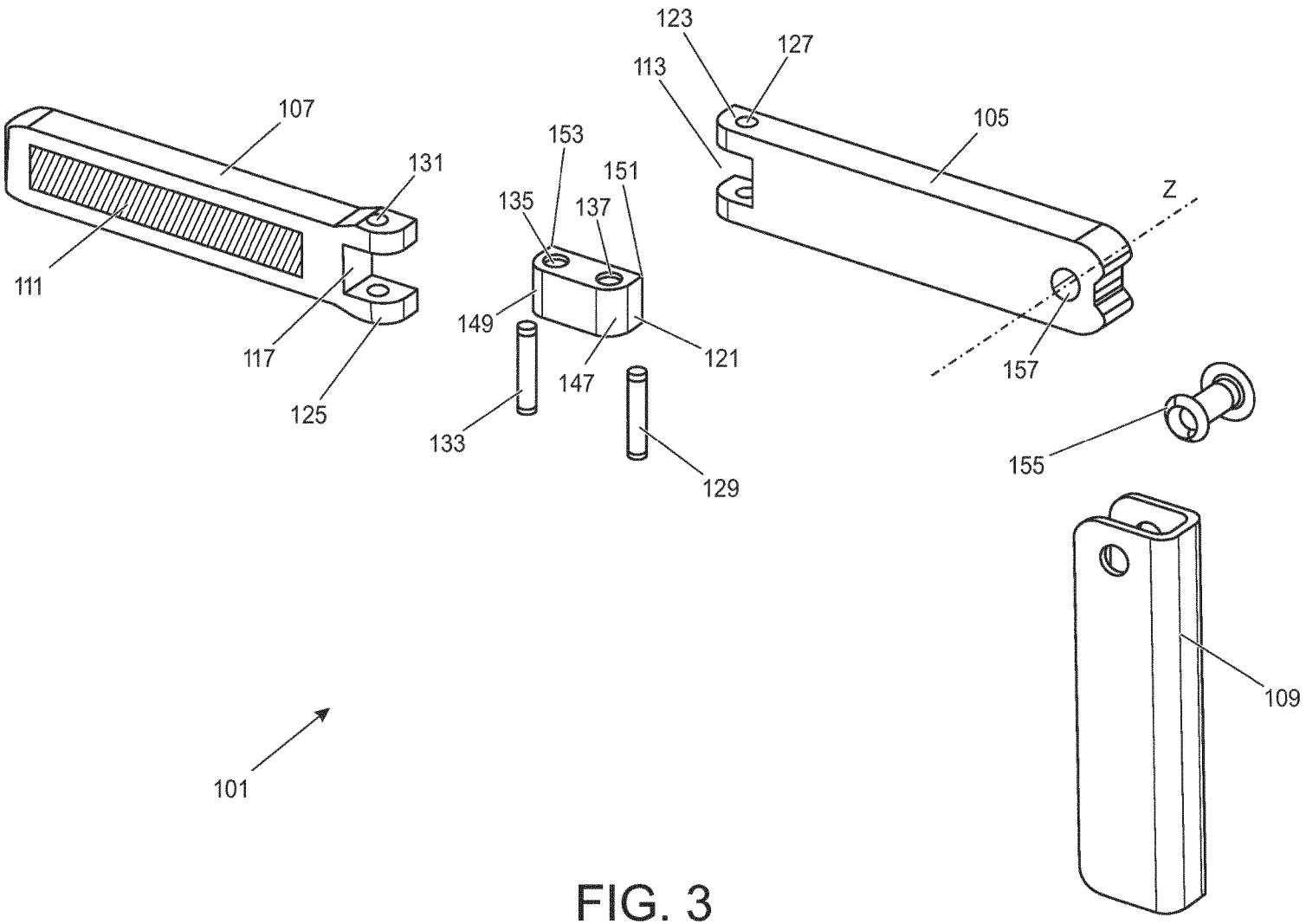
FIG. 3 shows an exploded perspective view of the key shown in FIGS. 2A and 2B.

An exploded perspective view of the key 101 is shown in FIG. 3. A first recess 113 is formed in the shank 105, and a second recess 117 is formed in the blade 107. A pivot link 121 is disposed between the shank 105 and the blade 107 within said first and second recesses 113, 117. The pivot link 121 is profiled such that, in use, it locates at least partially within the lock mechanism L. The first and second recesses 113, 117 form pairs of first and second pivot arms 123, 125 in the shank 105 and the blade 107 respectively. A first bore 127 extends through the first pivot arms 123 to receive a first pivot pin 129; and a second bore 131 extends through the second pivot arms 125 to receive a second pivot pin 133. The first and second pivot pins 129, 133 are disposed in first and second bores 135, 137 formed at each end of the pivot link 121 to form a pivoting coupling. The first and second pivot pins 129, 133 define first and second parallel pivot axes Y1, Y2 about which the shank 105 and the blade 107 pivot relative to the pivot link 121. The first and second parallel pivot axes Y1, Y2 are arranged parallel to each other and extend perpendicular to the longitudinal axis X.

As shown in FIG. 2B, the first pivot arms 123 each comprise a first curved corner 139 and a first orthogonal corner 141; and the second pivot arms 125 each comprise a second curved corner 143 and a second orthogonal corner 145. As shown in FIG. 3, the pivot link 121 comprises third and fourth curved corners 147, 149; and third and fourth orthogonal corners 151, 153. The curved corners 139, 143, 147, 149 are each defined by a sector of a right cylinder having a centre coincident with the respective first and second pivot axes Y1, Y2 defined by the first and second pivot pins 129, 133. When in its operative position, the curved corners 139, 143, 147, 149 are disposed on a first side of the key 101 adjacent to each other to allow the blade 107 to pivot in a first direction relative to the shank 105. The orthogonal corners 141, 145, 151, 153 are arranged on a second side of the key 101 adjacent to each other and function as stops to limit pivoting movement of the blade 107 in a second direction relative to the shank 105. The first and second directions are opposite to each other. If a force is applied in said second direction once the blade 107 is in said operative position, the orthogonal corners 141, 145, 151, 153 abut against each other and inhibit pivoting movement. Thus, pivoting movement of the blade 107 beyond the operative position in said second direction is prevented. In the present embodiment, the blade 107 can pivot through approximately 90° relative to the pivot link 121; and the pivot link 121 can pivot through approximately 90° relative to the shank 105. Thus, the pivoting coupling formed by the pivot link 121 allows the blade 107 to pivot through approximately 180° relative to the shank 105.

As shown in FIG. 3, the handle 109 is in the form of a C-shaped channel pivotally mounted to the shank 105. Specifically, the handle 109 pivots about a rivet 155 disposed in a third aperture 157 formed in the shank 105. The rivet 155 defines a third pivot axis Z arranged perpendicular to the longitudinal axis X and the first and second pivot axis Y1, Y2. The handle 109 is pivotable between a storage position in which the shank 105 is nested inside the handle 109; and a deployed position in which the handle 109 extends transversely to function as a lever for applying a turning force to rotate the key 101 about the longitudinal axis X. The handle 109 is shorter than the shank 105 and the blade 107 (approximately 26.65 mm in the present embodiment) and an interior of the C-shaped channel is sized to receive the shank 105.

The first and second bores 135, 137 in the pivot link 121 are offset from each other such that the end faces of the first and second pivot arms 123, 125 abut each other when the blade 107 is in its operative position. The abutment of the first and second pivot arms 123, 125 enables an axial load applied to the blade 107, for example when the key 101 is inserted into the lock mechanism L, to be transferred directly to the shank 105, thereby reducing loading applied to the first and second pivot pins 129, 133. Furthermore, the offset between the first and second bores 135, 137 is such that the shank 105 and the blade 107 are arranged substantially parallel to each other when the blade 107 is in the non-operative position. A uniform gap is maintained between the shank 105 and the blade 107 to accommodate a sidewall of the handle 109. When the key 101 is in its storage configuration, faces of the shank 105 and the blade 107 are positioned against the sidewall of the handle 109, as shown in FIG. 2B.

Figure 4A:
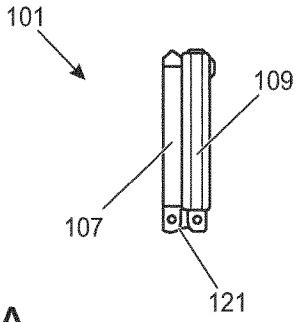
FIGS. 4A and 4B show plan and side elevations of the key shown in FIGS. 2A and 2B with the blade in a non-operative position.
Figure 4B:
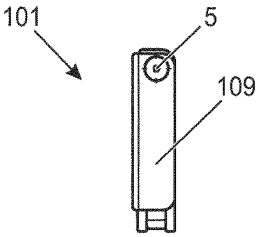
Figure 5A:
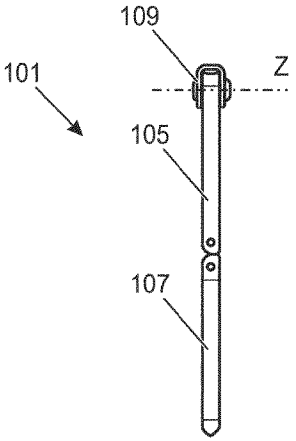
FIGS. 5A and 5B show plan and side elevations of the key shown in FIGS. 2A and 2B with the blade in an operative position.
Figure 5B:
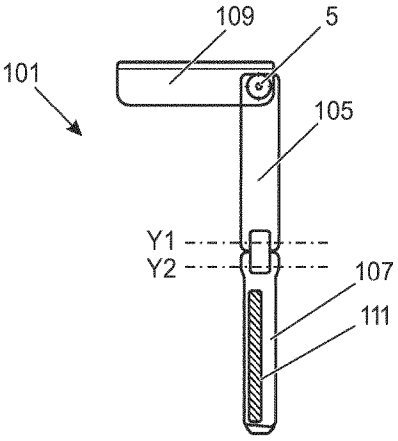

The key 101 is shown with the blade 107 in the non-operative position in FIGS. 4A and 4B; and with the blade 107 in the operative position in FIGS. 5A and 5B. The operation of the key 101 will now be described with reference to FIGS. 6A and 6B.

Figure 6B:
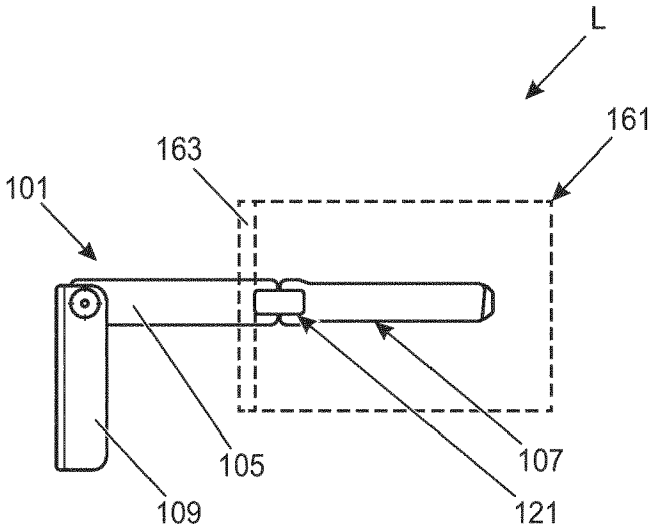
FIG. 6B shows the key operating a lock mechanism.
Figure 6A:
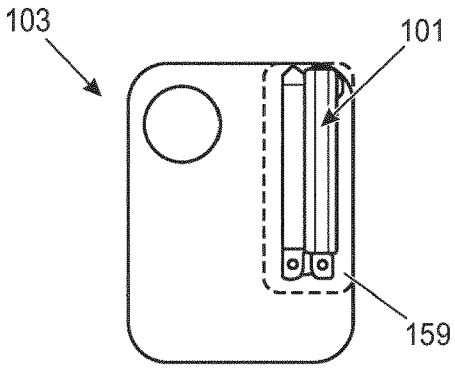
FIG. 6A shows the key stored in a compartment in an electronic key fob.

When the blade 107 is in the non-operative position, the key 101 can be stored in a storage compartment 159 in the electronic key fob 103, as illustrated in FIG. 6A. The key 101 is removed from the storage compartment 159 with the blade 107 in the non-operative position such that the blade 107 is disposed parallel to the shank 105 in the non-operative position. The blade 107 is then pivoted through approximately 180° to its operative position in which the shank 105 and the blade 107 are in alignment with each other along the longitudinal axis X. The handle 109 is pivoted through approximately 90° to its deployed position so as to extend substantially perpendicular to the longitudinal axis X.

As shown in FIG. 6B, the key 101 is then inserted into a rotatable barrel 161 of the lock mechanism L such that the blade 107 engages the lock tumblers (not shown). The key 101 is configured such that, when the blade 107 is inserted into the lock mechanism L, the pivot link 121 is disposed at least partially within the barrel 161 such that a portion of the shank 105 engages a portion of the barrel 161. In the illustrated arrangement, the shank 105 engages an outer member 163 of the barrel 161, such as a face plate. The key 101 is rotated about its longitudinal axis X to operate the lock mechanism L in conventional manner. When the key 101 is rotated, the shank 105 transmits a rotational force directly to the barrel 161 (rather than through the pivot link 121) causing the barrel 161 to rotate.

To return the key 101 to the storage compartment, the handle 109 is pivoted to its storage position so as to partially enclose the shank 105. The blade 107 is then pivoted through 180° relative to the shank 105 to its non-operative position in which the shank 105 and the blade 107 are arranged in a side-by-side configuration. With the blade 107 in the non-operative position, the key 101 can be inserted into the storage compartment 159 in the electronic key fob 103. The key 101 can be a restriction fit in the storage compartment 159 to retain it within the electronic key fob 103, or a separate catch or retaining mechanism can be provided.

It will be appreciated that various changes and modifications can be made to the key 101 described herein without departing from the scope of the present application. For example, a spring member, such as a leaf spring, could be incorporated into the key 101 to bias the blade 107 either towards its operative position or its non-operative position. Alternatively, or in addition, a locking mechanism could be provided to retain the blade 107 in its operative position or its non-operative position. The locking mechanism could, for example, comprise a magnet disposed in the handle 109 or in the pivot link 121.

The invention claimed is:

1. A key for operating a lock mechanism, the key comprising:

a shank; and a blade comprising a lock operating bit portion, wherein the blade is movable relative to the shank between an operative position and a non-operative position, and wherein the blade is disposed alongside the shank in the non-operative position, and the blade being pivotally coupled to the shank and pivoting between the operative position and the non-operative position, a pivot link being disposed between the shank and the blade, the pivot link being pivotally connected to the shank and to the blade, wherein the pivot link is configured to allow pivoting movement of the blade in a first direction from the operative position and to inhibit pivoting movement of the blade in a second direction from the operative position.

2. The key as claimed in claim 1, wherein the blade and the shank are aligned with each other along a longitudinal axis when the blade is disposed in the operative position.

3. The key as claimed in claim 1, wherein the blade is configured to pivot 180° relative to the shank.

4. The key as claimed in claim 1, wherein the pivot link is disposed in first and second recesses formed in respective ends of the shank and the blade.

5. The key as claimed in claim 4, wherein the ends of the shank and the blade abut each other when the shank is in its operative position.

6. The key as claimed in claim 1, wherein the pivot link is configured to pivot 90° in the first direction relative to the shank, and wherein the blade is configured to pivot 90° in the first direction relative to the pivot link.

7. The key as claimed in claim 1, further comprising a handle mounted to the shank, wherein the handle is pivotable between a storage position and a deployed position, and wherein, when the handle is in the storage position, at least a portion of the handle is disposed between the blade and the shank.

8. The key as claimed in claim 7, wherein the pivot link is configured such that the blade and the shank are arranged parallel to each other when the handle is in the storage position.

9. The key as claimed in claim 7, wherein the pivot link is pivotally connected to the shank at a first pivot axis, wherein the pivot link is pivotally connected to the blade at a second pivot axis parallel to the first pivot axis, and wherein the handle is pivotally connected to the shank at a third pivot axis perpendicular to the first pivot axis and second pivot axis.

10. The key as claimed in claim 1, wherein a length of the blade is the same as a length of the shank.

11. The key as claimed in claim 1, wherein the shank is operatively configured to apply torque to the lock mechanism to rotate a barrel and to operate the lock mechanism.

12. The key as claimed in claim 1, further comprising a spring member configured to bias the blade towards the operative position.

13. The key as claimed in claim 1, further comprising a locking mechanism configured to lock the blade in the operative position.

14. The key as claimed in claim 1, wherein the blade comprises a unitary rigid member in which the lock operating bit portion is formed, and/or wherein the key is configured to operate a lock mechanism of an automotive vehicle.

15. The key as claimed in claim 1 in combination with a key fob, wherein the key fob comprises a storage compartment configured to store the key when the blade is in the non-operative position.

* * * * *